US009556544B2

(12) United States Patent
Gerth et al.

(10) Patent No.: US 9,556,544 B2
(45) Date of Patent: Jan. 31, 2017

(54) HEDDLE FOR A LOOM, IN PARTICULAR A CIRCULAR LOOM

(71) Applicant: Groz-Beckert KG, Albstadt (DE)

(72) Inventors: Christian Gerth, Albstadt (DE); Rainer Grossman, Schwenningen (DE); Mario Gusenko, Albstadt (DE)

(73) Assignee: GROZ-BECKERT KG, Albstadt (DE)

( * ) Notice: Subject to any disclaimer, the term of this patent is extended or adjusted under 35 U.S.C. 154(b) by 58 days.

(21) Appl. No.: 14/441,417

(22) PCT Filed: Nov. 6, 2013

(86) PCT No.: PCT/EP2013/073144

§ 371 (c)(1),
(2) Date: May 7, 2015

(87) PCT Pub. No.: WO2014/072332

PCT Pub. Date: May 15, 2014

(65) Prior Publication Data

US 2015/0308020 A1 Oct. 29, 2015

(30) Foreign Application Priority Data

Nov. 8, 2012 (EP) ..... 12191836

(51) Int. Cl.
*D03C 9/04* (2006.01)
*D03C 9/02* (2006.01)
(Continued)

(52) U.S. Cl.
CPC ..... *D03C 9/02* (2013.01); *B21F 45/08* (2013.01); *D03C 9/024* (2013.01); *D03C 9/06* (2013.01); *D03C 9/0608* (2013.01); *D03D 41/008* (2013.01)

(58) Field of Classification Search
CPC ..... D03C 9/024; D03C 9/02; D03C 9/028
See application file for complete search history.

(56) References Cited

U.S. PATENT DOCUMENTS 6,283,163 B1 9/2001 Kagi
7,467,646 B2 12/2008 Mettler et al.
(Continued)

FOREIGN PATENT DOCUMENTS

CN 1940157 A 4/2007
CN 201924128 U 8/2011
(Continued)

OTHER PUBLICATIONS

International Search Report in corresponding International Application No. PCT/EP2013/073144, dated Jan. 17, 2014, 4 pages.
(Continued)

*Primary Examiner* — Bobby Muromoto, Jr.
(74) *Attorney, Agent, or Firm* — Fitch, Even, Tabin & Flannery LLP

(57) ABSTRACT

A heddle (10) is provided for weaving strip-shaped warp yarn. Said heddle (10) includes a heddle shaft (12) formed by two shaft parts (13). Said shaft parts (13) are placed on top of each other in a respective end section (15) of the heddle shaft (12) and interconnected. The end eyelets (16) of the heddle (10) are also in said end section (15). To form a yarn eye between both shaft parts (13), two separate warp yarn guiding bodies (20) are placed therebetween. To determine the position of the warp yarn guiding body (20) with respect to the heddle shaft (12), at least one shaft projection (22) is produced by stamping and subsequent bending or embossing each shaft part (13) for each warp yarn guiding body (20). Said shaft projection (22) engages in an associated recess (25) of the warp yarn guiding body (20), and a bonding connection is produced.

16 Claims, 9 Drawing Sheets

(51) Int. Cl.

| | |
|---|---|
| ***D03D 41/00*** | (2006.01) |
| ***D03C 9/06*** | (2006.01) |
| ***B21F 45/08*** | (2006.01) |
| *D03C 9/00* | (2006.01) |

(56) References Cited

U.S. PATENT DOCUMENTS

| | | | |
|---|---|---|---|
| 7,469,723 | B2 | 12/2008 | Himmelstoss |
| 7,963,301 | B2 | 6/2011 | Stauss et al. |
| 2007/0084518 | A1 | 4/2007 | Himmelstoss |

FOREIGN PATENT DOCUMENTS

| | | | |
|---|---|---|---|
| CN | 102177286 | A | 9/2011 |
| DE | 2351795 | A1 | 4/1975 |
| DE | 102007048761 | A1 | 4/2009 |
| EP | 1015675 | B1 | 7/2001 |
| EP | 1795635 | A1 | 6/2007 |
| EP | 1795636 | A1 | 6/2007 |
| EP | 2166138 | A1 | 3/2010 |
| JP | 2001-303383 | A | 10/2001 |
| JP | 2007154405 | A | 6/2007 |
| JP | 2007154406 | A | 6/2007 |
| JP | 2008045255 | A | 2/2008 |
| WO | 2010105314 | A2 | 9/2010 |
| WO | 2010121810 | A1 | 10/2010 |
| WO | 2014/072041 | A1 | 5/2014 |

OTHER PUBLICATIONS

International Search Report in corresponding International Application No. PCT/EP2013/003316, dated Jan. 29, 2014, 6 pages.

European Search Report and Opinion in European Application No. 12 19 1836, dated Jan. 14, 2013, 8 pages.

European Search Report and Opinion in European Application No. 13 00 3701, dated Jan. 20, 2012, 12 pages.

Notice of Reasons for Refusal in Japanese Application No. 2015-541033, dated Dec. 24, 2015, 9 pages.

Notice of Reason for Refusal in Korean Application No. 10-2015-7011798, dated Oct. 21, 2015, 7 pages.

Office action and Search Report in Chinese Application No. 201380058225.6, dated Mar. 29, 2016, 2 pages.

Office Action in European Application No. 13 003 7001, dated Jan. 5, 2015, 4 pages.

Second office action in corresponding Chinese Application No. 201380058225.6, dated Sep. 27, 2016, 6 pages.

HEDDLE FOR A LOOM, IN PARTICULAR A CIRCULAR LOOM

CROSS REFERENCE TO RELATED APPLICATIONS

This patent application is the national phase of PCT/EP2013/073144 filed Nov. 6, 2013, which claims the benefit of European Patent Application No. 12191836.1 filed Nov. 8 2012.

TECHNICAL FIELD

The present invention relates to a heddle for a loom that is suitable, in particular, for use in a circular loom.

BACKGROUND

Furthermore, the heddle is to be disposed for the use of strip-shaped warp yarn.

There exist a plurality of different known shapes and embodiments of heddles for different applications. For example, publication DE 23 51 795 A1 describes a heddle for processing wires, for example for the production of mattress supports. The heddle comprises a heddle shaft that is held on both ends in the heddle frame. The heddle shaft comprises two shaft parts that abut tightly against each other at least at the two end sections. In order to form a yarn eye in the central region of the heddle shaft, cylindrical pins extending transversely to the direction of extension of the heddle shaft are inserted between the two shaft parts. The yarn eye for guiding the warp wire is formed between these two pins.

Publication EP 1 795 635 B1 describes a heddle known for processing strip-shaped warp yarns. There, the heddle shaft is made of a strip that has a cutout to form the yarn eye. For guiding the strip-shaped warp yarn, the guiding surfaces delimiting the yarn eye are rounded by various measures, for example by the use of elements having curved yarn guiding surfaces or by bending over punched out latches of the heddle shaft adjoining the yarn eye.

EP 2 166 138 A1 discloses a jacquard heddle for use in jacquard machines. The heddle body or heddle shaft is made of a round material in this case. The round material has a flat section that has an opening for the heddle mail, said opening being delimited by two limbs that thus represent spaced-apart shaft parts. The heddle mail may be glued between the two shaft parts. Ribs may be provided on the shaft parts, said ribs engaging in a groove on the heddle mail in order to hold the mail well and securely.

EP 1 795 636 B1 shows a heddle with a heddle shaft of two parallel-extending strip-shaped shaft parts, in which case two spaced-apart cylindrical pins extending in the direction of extension of the heddle shaft may be provided for delimiting the yarn eye in the central region of the heddle shaft. Each of these pins represents a warp yarn guiding body. The cylindrical warp yarn guiding bodies may be, for example, glued, welded, riveted or soldered to the strip-shaped shaft parts. A similar heddle is also known from publication JP 2001-303383 A.

SUMMARY

Considering heddles that are made of two separate shaft parts extending along the direction of extension of the heddle shaft, it must be ensured that the yarn eye is located exactly in a desired position between the two end eyelets in order to hold the warp yarn—depending on the shed position—in the desired position. Furthermore the yarn eye must ensure that the warp yarn will not be damaged. Considering strip-shaped warp yarns, there is the additional aspect that a pleat formation of the warp strip must be prevented during the weaving operation. Therefore, it may be viewed as the object of the invention to provide a heddle that satisfies these requirements and that, at the same time, can be produced in an economical manner.

The heddle in accordance with the invention is particularly suitable for the weaving of strip-shaped warp yarns or warp strips. Frequently, such warp strips consist of plastic material, for example of oriented polypropylene. Polypropylene that has been oriented in such a manner displays high tearing strength in its longitudinal direction, i.e., the direction in which it was oriented. However, due to the orientation, the tearing strength transversely to the direction of extension of the strip is reduced. By weaving such strips, a fabric that is resistant to tearing in both directions can thus be attained, for example, to produce tear-resistant sacks.

The heddle in accordance with the invention has a heddle shaft consisting of two separate shaft parts that have the shape of strips, in particular. The two shaft parts are provided as separate elements and are indirectly interconnected by the at least one warp yarn guiding body to produce the heddle. At least in sections, for example in the region of a yarn eye of the heddle, these two shaft parts extend—at a distance from each other—in a transverse direction transversely to the direction of extension of the heddle shaft and transversely to a warp yarn direction. Viewed in the direction of extension of the heddle shaft, said heddle shaft has respectively one end eyelet at its two end sections for fastening the heddle to a heddle mounting rail or another holding arrangement of the heddle shaft.

The end eyelets may be provided on the end eyelet parts that are connected to respectively one or both shaft parts in the respective end section. Alternatively, the end eyelet may also be directly formed by the shaft parts. At least in the end sections, the two shaft parts may be interconnected in one embodiment of the invention herein, and preferably, directly abutting against each other. For the indirect connection, it is possible to use suitable connecting bodies that extend between the two shaft parts at a connecting site. Consequently, the two shaft parts may be connected indirectly or directly to each other in at least one connecting location by gluing and/or welding or by another bonding connection and/or mechanically, positively and/or nonpositively—for example, by means of a rivet connection. The end section, measured in the direction of extension, may have a length of several centimeters, for example at most 3 to 5 cm. The two shaft parts extend in the direction of extension of the heddle shaft at least from one end section to the other end section and, preferably, from one free end to the respectively other free end of the heddle shaft.

For delimiting the yarn eye, at least one warp yarn guiding body is interposed between the two shaft parts and connected to the two shaft parts. The yarn eye is completely closed in circumferential direction about a warp yarn direction and is disposed for guiding a warp yarn. In one embodiment, the yarn eye is delimited by at least one warp yarn guiding body on all sides. In another embodiment, the yarn eye is delimited on the upper side and on one opposite lower side by respectively one warp yarn guiding body, in which case the yarn eye is laterally directly delimited by the shaft parts. The at least one warp yarn guiding body may consist of one or more parts. If a one-part warp yarn guiding body is used, it has both guiding surfaces opposite each other in the direction of extension, in which case the warp yarn abuts against said guiding surfaces and can be guided through the yarn eye. In a preferred embodiment, two warp yarn guiding bodies are interposed between the two shaft parts, in which case each warp yarn guiding body has one of the two guiding surfaces of the yarn eye, and the warp yarn guiding bodies are not directly interconnected.

A particularly low-wear warp yarn guiding function is provided when the plane of the opening of the yarn eye extends approximately at a right angle to a plane that is oriented parallel to the opening of the end eyelets. In other words, the opening of the yarn eye is located in one plane that extends through the warp yarn direction and the extension direction of the heddle shaft, and the end eyelets have an opening in a plane that extends through the warp yarn direction and the transverse direction.

For simple and precise positioning of the yarn eye, each shaft part has at least one shaft projection formed by stamping and/or bending and/or embossing, in which case the shaft projection projects from one shaft part toward the respectively other shaft part. The term stamping is understood to refer to any option of penetrating the material of the shaft part at certain points and thus separate it, in particular by punching and/or cutting. For each shaft projection, the at least one warp yarn guiding body has an associate recess in which engages said shaft projection. Via the shaft projection, it is thus possible to create a positioning means that prespecifies the position of the warp yarn guiding body on the shaft part. As a result of this, a machine production of the heddle is considerably simplified. Alternatively or additionally to the bonding connection, the shaft projection can also attain a positive and/or nonpositive connection with the recess between the warp yarn guiding body and the respective shaft part. Consequently, additionally or alternatively to the bonding connection, an interlocking and/or snapping-in of the at least one warp yarn guiding body between at least two shaft projections of the two shaft parts may occur. In doing so, the shaft projection may, for example be elastically deformed and—with the connection established—exert a pressing force on the warp yarn guiding body. By interconnecting the two shaft parts by way of a connecting element or directly, the pressing force can be opposed, as a result of which the warp yarn guiding body is held between the shaft parts.

If a bonding connection is provided between the shaft parts and the at least one warp yarn guiding body, this connection can be produced by gluing and/or welding and/or other thermal joining processes.

In the production of the heddle, the warp yarn guiding body can be precisely inserted in the desired position between the two shaft parts, so that the shaft projections engage in the associate recesses. Subsequently, preferably a bonding connection by gluing and/or welding is formed between the warp yarn guiding body and the respective shaft part. In the region of this recess on the warp yarn guiding body, into which recess engages the respective shaft projection, a large area is provided for a bonding connection. In the preparation of such a bonding connection, it is possible for unevennesses or elevations to form at the joining site, for example in the process of gluing or welding. As a result of the fact that these unevennesses can optionally be formed in the region of the recess of the warp yarn guiding body, there is no risk that warp yarn guiding sections of the heddle are impaired as to their form. Consequently, the possibility is provided that at least one warp yarn guiding body is bonded to the shaft parts, in which case the sections of the heddle where they come into contact with a warp yarn—i.e., the outside surface of the shaft part as well as the region of the yarn eye—remain unimpaired by the provision of the bonding connection. Such a heddle can be produced in a very simple manner and can also be machine-manufactured. Shape changes during the production that can lead to an increased stress of or damage to a warp yarn are avoided.

The two shaft parts of the heddle shaft preferably consist of a metal or a metal alloy. The at least one warp yarn guiding body may consist of the same material as the shaft parts. The warp yarn guiding bodies may also be provided with a coating in order to minimize the friction between the guiding surface of a warp yarn guiding body that may support the warp yarn and the warp yarn. The at least one warp yarn guiding body may consist of ceramic, hard metal or plastic, in particular of reinforced plastic—for example, a composite material.

Preferably, the two shaft parts are strip-shaped, in which case their width measured in warp yarn direction is at least five to ten times greater than the thickness in transverse direction.

In order to improve the stability of the heddle, the at least one warp yarn guiding body is preferably bonded to the two shaft parts; in particular, this bonding connection between the shaft projection of the respective shaft part and the respectively associate recess of the warp yarn guiding body is provided. The number of recesses on the warp yarn guiding body and the shaft projections engaging in the respective recess may vary. Thus, several shaft projections may also be associated with a shared recess on the warp yarn guiding body. In a preferred embodiment of the heddle, each shaft part has one or two shaft projections for each warp yarn guiding body.

In preferred embodiments of the heddle there are two separate, not directly interconnected warp yarn guiding bodies. A guiding surface acting as the abutment surface for the warp yarn is provided on each warp yarn guiding body, in which case the warp yarn—depending on the shed position—abuts either against one guiding surface or the other guiding surface. Viewed in warp yarn direction, the guiding surfaces are configured preferably curved and without edges and offsets. In transverse direction, namely between the two shaft parts, the guiding surfaces are plane, in particular at each point. The height of the yarn eye measured in the direction of extension of the heddle shaft corresponds to the minimal distance between the two guiding surfaces and is preferably at most 1.5 mm. The width of the yarn eye in transverse direction is, in particular, greater and, preferably, at least two to five times greater than the height of the yarn eye in the direction of extension of the heddle shaft.

In one exemplary embodiment, the shaft projection is at a distance from the two edges of the respective shaft part extending in the direction of extension. A space may exist between the shaft projection and the edge of the respective shaft part.

In one embodiment, the shaft part may transition into the shaft projection without gaps or cutouts. In this embodiment, there is no opening in the shaft part next to the shaft projection. Such a shaft projection may be produced in particular by embossing. The manufacture of the at least one shaft projection without opening on the shaft part ensures that no other projecting deformations will form, when a bonding connection is produced between the shaft projection and the warp yarn guiding body on the outside of the shaft part facing away from the yarn eye. In another exemplary embodiment, the shaft projection may be formed by a latch that is separated by a slit from the shaft part. For example, the slit may have a U-shape with corners or be rounded and expose the latch on three sides relative to the shaft part. In order to produce the connection, this latch may very simply be bent into the recess.

Furthermore, it is possible that the at least one warp yarn guiding body comprises a transversely extending extension—in particular in extension of its guiding surface for the warp yarn. This extension comes into engagement with a recess or cutout at the associate shaft part. Viewed in transverse direction, the guiding surface on the warp yarn guiding body can be extended into the recess of the shaft part via this extension. In this embodiment, no gap can form in the extension direction of the heddle shaft between the warp yarn guiding body and the respective shaft part, in which gap a warp yarn could become caught and damaged. Preferably, the extension has a cross-sectional form that is not rotation—symmetrical. In particular, said extension it is in abutment at three locations—and preferably in planar abutment—along the entire guiding surface in the recess on the shaft part. Preferably, the extension transitions without offset into the guiding surface, or there is a transition surface essentially along the adjacent shaft part inside the yarn eye, said transition surface connecting the guiding surface and the extension without gaps.

Considering an advantageous embodiment, the warp yarn guiding body tapers away from the yarn eye in the direction of extension of the heddle shaft. To do so, said heddle shaft may have a lateral surface that is curved or extends in an inclined manner to the direction of extension, at least in sections, and that is associated with the respective shaft part. In one exemplary embodiment, this lateral surface has two surface sections that—in the direction of extension—subtend different angles of inclination. In particular, the two surface sections are directly adjacent to each other. Due to this embodiment of the warp yarn guiding body, it is possible to guide the two shaft parts—starting from the warp yarn guiding body—toward the respective end eyelets in an inclined manner such that an abutment between the two shaft parts is possible at a minimal distance from the yarn eye. As a result of this, it is possible to also produce relative short heddles in the extension direction E. The two shaft parts may also be directly adjacent and/or interconnected outside the end section, thus increasing the stability and the torsional stiffness of the heddle.

In one embodiment, the at least one warp yarn guiding body may have a flow groove for the distribution of glue in its lateral surface associated with the respective shaft part. The at least one flow groove preferably extends in warp yarn direction. The flow groove may also receive excess glue.

In one advantageous embodiment, a glue reservoir may be provided on the warp yarn guiding body, in which case the recess associated with the shaft projection may act as the glue reservoir. The formation of a bonding connection by gluing is simplified as a result of this. In particular, the glue reservoir may have a filling opening for the glue that terminates on a rear side of the warp yarn guiding body. The rear side of the warp yarn guiding body faces away from the guiding surface provided by the support of the warp yarn.

Furthermore, it is advantageous if the glue reservoir fluidically communicates with the at least one flow groove so that the glue therein can be uniformly distributed via the flow groove.

A heddle exhibiting the features described hereinabove may be produced in the following manner:

Firstly, the two shaft parts are provided, for example they are punched or cut out of a plate-shaped or foil-shaped starting material. In doing so, the end eyelets may already be provided as cutouts in each shaft part. At the time when the shaft parts are punched or cut out, or during a subsequent process step, at least one shaft projection is formed on each shaft part by separation and/or bending and/or embossing. For example, in one exemplary embodiment, a combined stamping—in particular punching—and bending may be used for the formation of the shaft projection. Alternatively, it is possible to produce a shaft projection by embossing, without opening on the shaft part. The two shaft parts may be placed in intimate contact next to each other and interconnected at least at the two end section, for example, by means of a bonding connection such as, e.g., by gluing and/or welding. Alternatively, this connection may also be produced after mounting the at least one warp yarn guiding body.

In order to form the yarn eye at least one and preferably two warp yarn guiding bodies are arranged and fastened between the two shaft parts. The shaft projection is disposed to prespecify the position of the warp yarn guiding body and/or its orientation relative to the shaft part. In doing so, the recesses of the warp yarn guiding body are arranged between the shaft parts in such a manner that the at least one shaft projection provided on each of the shaft parts comes into engagement with the respectively associate recess. In order to produce a bonding connection, it is possible—before or after installing the warp yard guiding body between the shaft parts—to inject glue into a glue reservoir on the warp yarn guiding body, said glue reservoir being represented by the recess, for example.

BRIEF DESCRIPTION OF THE DRAWING

Advantageous embodiments of the invention can be inferred from the dependent patent claims as well as from the description. The description is restricted to essential features of the invention. The drawings are to be used for supplementary reference. Hereinafter follows a detailed description of the invention with reference to the appended drawings. They show in FIG. 1 a perspective view of a first exemplary embodiment of a heddle in accordance with the invention;

DETAILED DESCRIPTION

Figure 1:
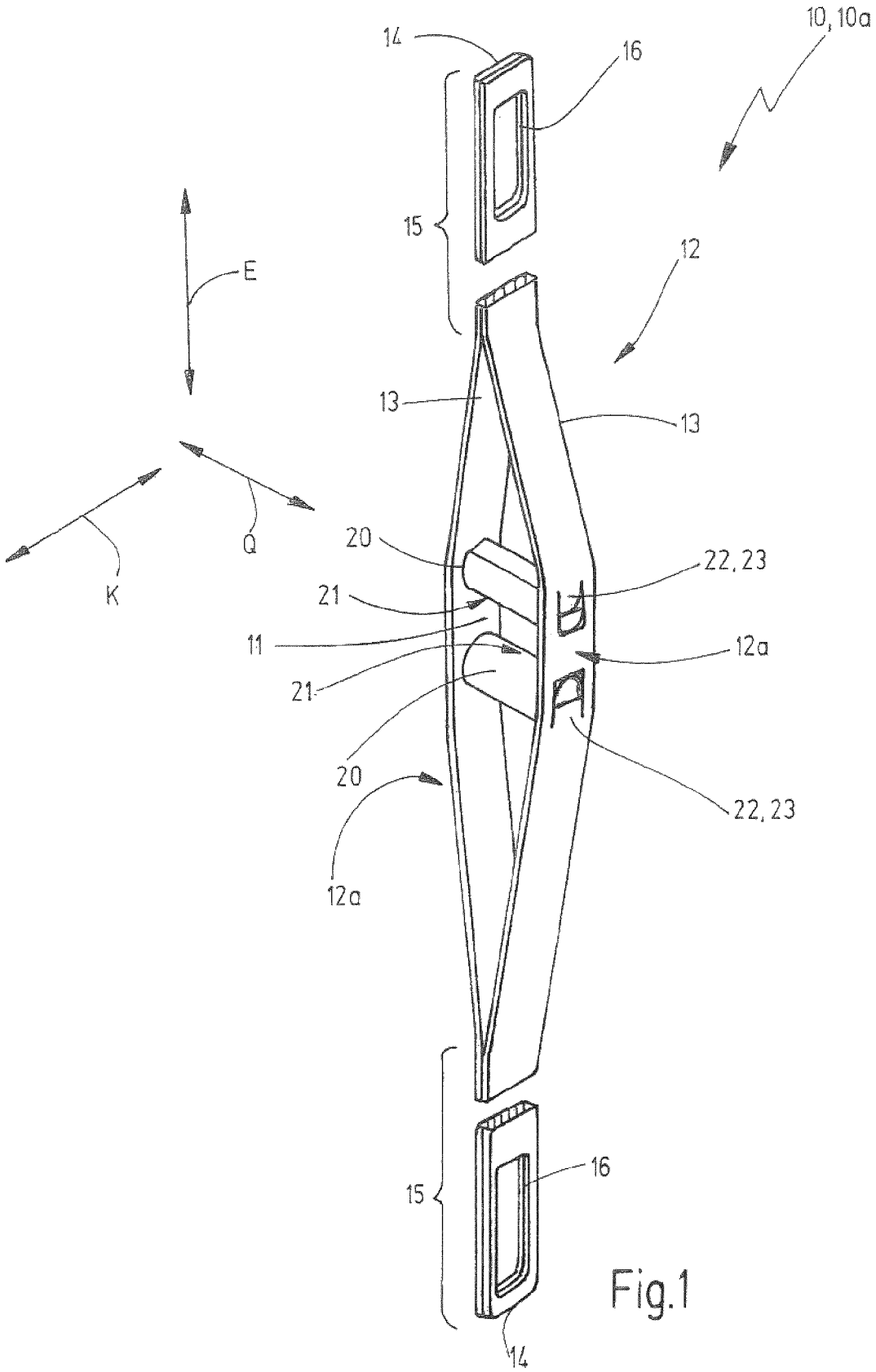
Figure 2:
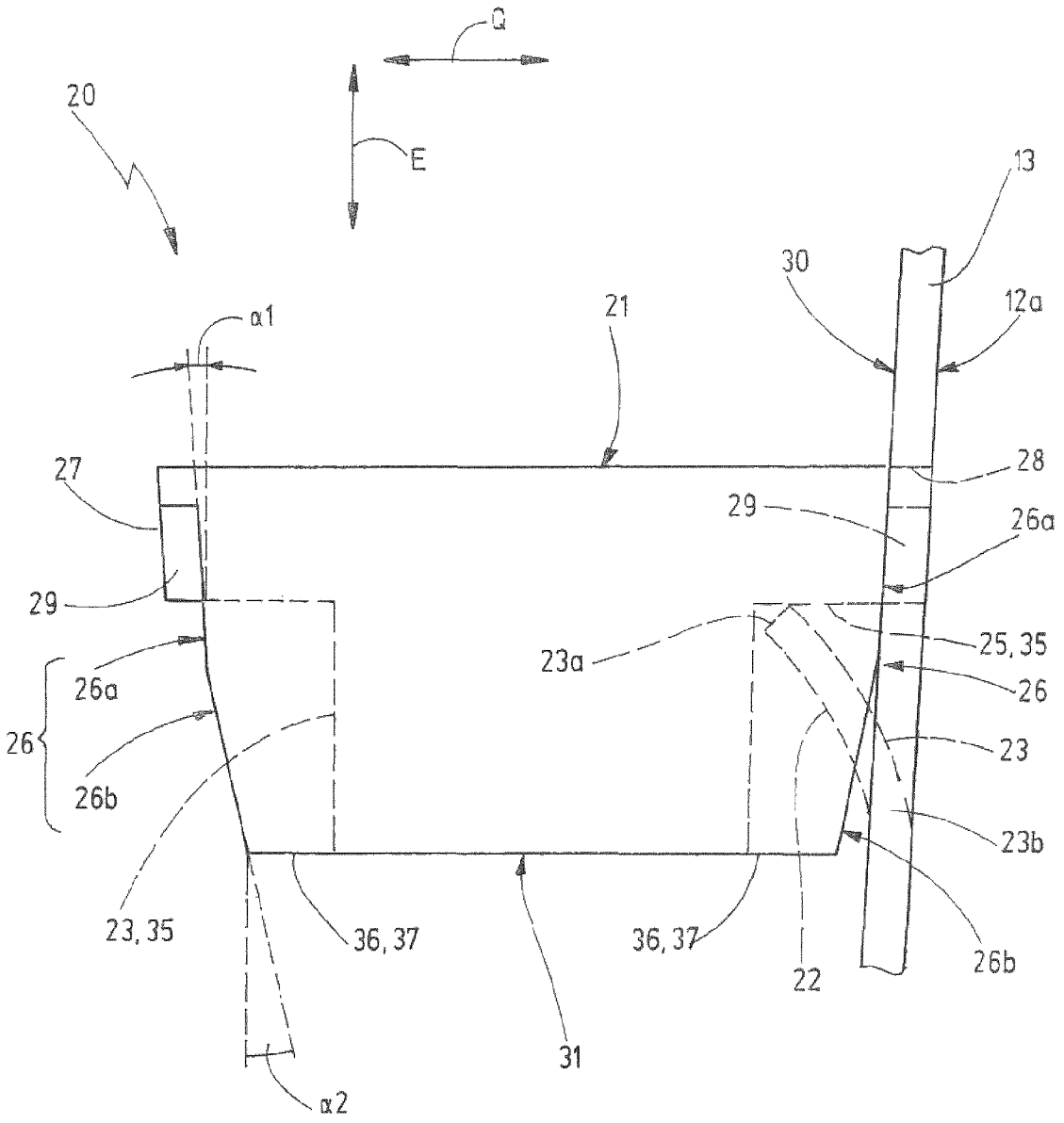
FIG. 2 a schematic view in warp yarn direction of a warp yarn guiding body of the first exemplary embodiment as in FIG. 1 for delimiting the yarn eye.
Figure 3:
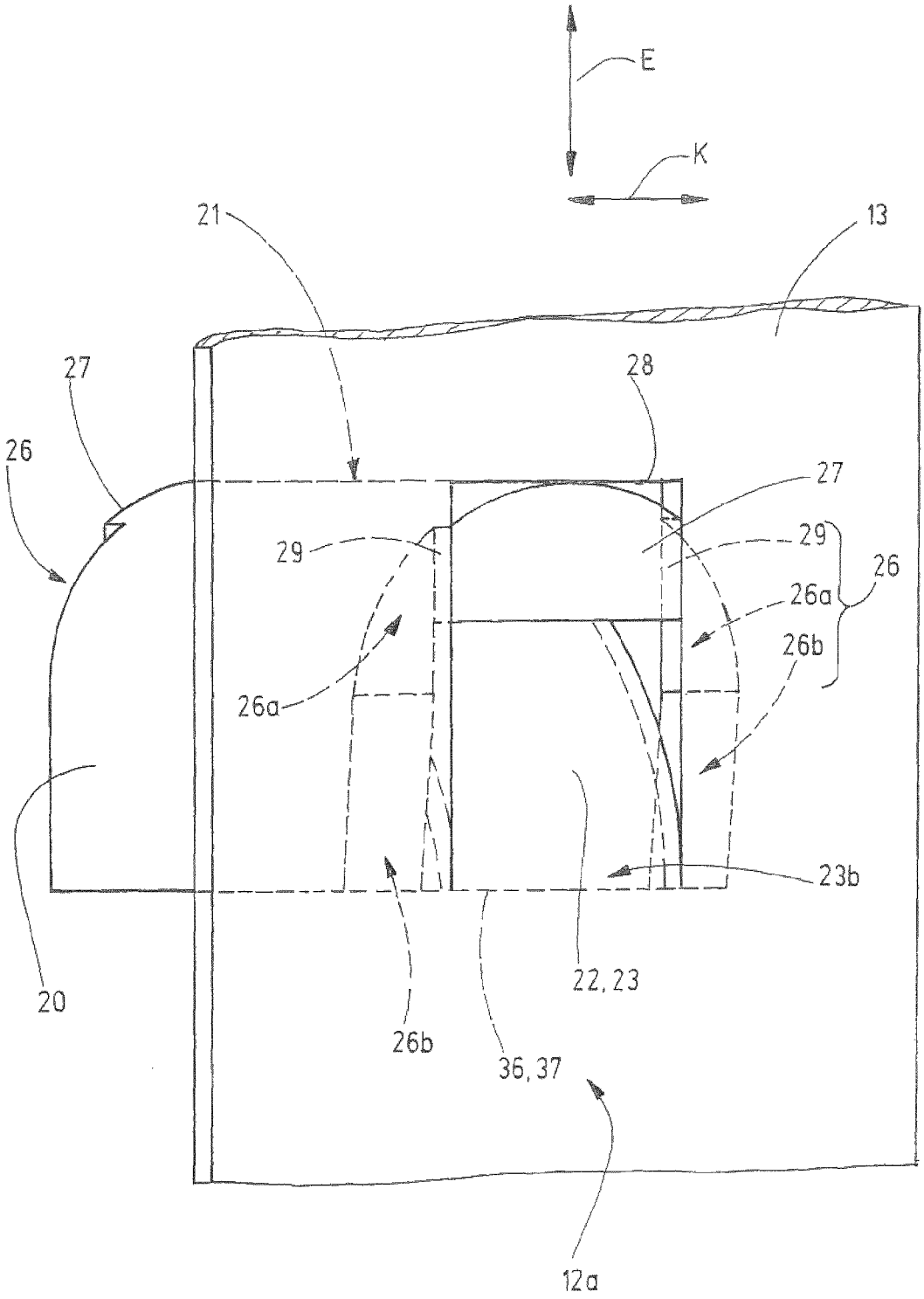
FIG. 3 a perspective representation of the warp yarn guiding body of FIG. 2.

FIGS. 1 through 3 illustrate a first exemplary embodiment 10*a* of a heddle 10. The heddle 10 is disposed for guiding a warp yarn during the weaving process. In doing so, the warp yarn moves through a yarn eye 11 of the heddle 10. The heddle 10 is arranged in a not illustrated heddle shaft of the weaving machine that moves in vertical direction in order to bring the warp yarn guided through the yarn eye 11 of the heddle 10 into a desired shed position. The heddle 10 described here is disposed, in particular, for weaving strip-shaped warp yarns that are used, as a rule, in technical fabrics. In particular, the processing of plastic strips, for example of oriented polypropylene, to produce a fabric is intended. Depending on the process used for their production, the plastic strips display—in some cases—a greater tearing strength in their direction of extension than in transverse direction. Therefore, the warp yarn must not be stressed too much in a transverse direction transversely to the warp yarn direction K in order to avoid damage. In the fabric that is being produced, the force acting on the warp yarn is absorbed by the weft yarn, so that an overall tear-resistant fabric is formed. The heddle 10 in accordance with the invention is particularly suitable for the use in circular looms, in which hose-like fabrics are produced.

In all the exemplary embodiments the heddle 10 has a heddle shaft 12 made of two separate, for example, strip-shaped shaft parts 13. Viewed in extension direction E, the shaft parts 13 extend completely between the two free ends 14 of the heddle shaft 12. The free ends 14, respectively, are at an end section 15 of the heddle shaft 12, in which an end eyelet 16 is provided for fastening the heddle 10 to a heddle mounting rail of the heddle shaft. As shown by the first exemplary embodiment 10*a* of the heddle 10, the end eyelet 16 may be configured as a closed ring, namely as an O-shaped end eyelet 16. Alternatively, the end eyelet 16 may be partially open on a longitudinal side extending in the extension direction E, as a result of which a C-shaped or J-shaped end eyelet is attained.

The two strip-shaped shaft parts are placed in a planar manner directly against each other and connected in a planar manner or at some points in the end sections 15. This connection is preferably accomplished by material bonding, for example by gluing and/or welding. Considering the exemplary embodiment 10*a* of the heddle 10 shown by FIG. 1, the two shaft parts 13 are not interconnected outside the end section 15 and are arranged, as in the example, in a transverse direction Q transversely to the extension direction E and transversely to a warp yarn direction K at a distance from each other. The transverse direction A and the extension direction E define a plane in which the passage opening of the yarn eye 11 is located. The warp yarn direction K is oriented at a right angle to the extension direction E and to the transverse direction Q. Depending on the shed position, it may by all means be possible for the warp yarn to move diagonally through the yarn eye 11. The term warp yarn direction K is defined as the direction that extends at a right angle to the opening plane defined by the yarn eye 11.

In the preferred embodiments of the heddle 10 described herein, the end eyelets 16 are directly formed by the cutouts in the two strip-shaped shaft parts 13. They can be made of a starting material, for example, when the shaft parts 13 are punched or cut out. In accordance with the example, the shaft parts 13 consist of a metal or a metal alloy. Alternatively, the shaft parts 13 may also consist of a plastic and/or a composite material.

In order to form the yarn eye 11, there is between the two shaft parts 13 at least one warp yarn guiding body 20 that connects the two shaft parts 13 to each other in transverse direction Q. In the exemplary embodiments described herein, the heddle 10 comprises two warp yarn guiding bodies 20 arranged at a distance from each other in the extension direction E, said guiding bodies being configured separately from each other and not being directly interconnected. Each of the two warp yarn guiding bodies 20 has on its side facing the other warp yarn guiding body 20 a guiding surface 21 that acts as the abutment surface for the warp yarn guided through the heddle 10. The guiding surface 21 is convexly curved in warp yarn direction K. The guiding surface 21 is completely straight in transverse direction A between the two shaft parts 13.

In the exemplary embodiments shown here, the two warp yarn guiding bodies 20 are identical for delimiting the yarn eye 11. The heddle 10 is symmetrical to a longitudinal plane that is defined by the warp yarn direction K and the extension direction E.

In modification of the exemplary embodiments described here, it could also be that only one warp yarn guiding body 20 is used, said guiding body binding the yarn eye 11 and enclosing it in the form of a ring. The width of the yarn eye 11 is adapted to the width of the strip-shaped warp yarn that is to be woven, so that the width of the yarn eye 11 measured in transverse direction A is the same or only minimally greater than the width of the strip-shaped warp yarn. As a result of the fact that, in the exemplary embodiment, two separate warp yarn guiding bodies 20 are used and the yarn eye is not delimited in transverse direction Q by one or both warp yarn guiding bodies but by the two shaft parts 12, the dimensions of the heddle 10 in transverse direction Q may be very small. This has the advantage that the density of the warp yarns for the fabric to be produced becomes correspondingly high.

At least one shaft projection 22 exists on each shaft part 13 for each of the warp yarn guiding bodies 20. The shaft projection 22 of the first exemplary embodiment 10*a* of the heddle 10 can be recognized in FIGS. 2 and 3, in particular. In the first exemplary embodiment 10*a*, exactly one shaft projection 22 exists on each shaft part 13 for each warp yarn guiding body 20. The shaft projection 22 is made of the material of the respective shaft part 13 due to a deformation. In the first exemplary embodiment 10*a*, the shaft projection 22 is formed by stamping and bending. At the desired position for mounting the warp yarn guiding body 20, a latch 23 having a free end 23*a* is exposed on each shaft part 13, for example by being punched out or cut out, said latch being subsequently bent out of the plane of the shaft part 13 and thus forming the shaft projection 22. The latch 23 is separated on its free end 23*a* and the two opposite longitudinal sides from the remaining material of the shaft part 13, as a result of which a U-shaped slit is formed around the latch 23, as it were. On the free end 23*a* opposite the fixed end 23*b*, the latch 23 is connected to the shaft part 13 free of seams or joints. It is understood that also other slit forms are possible. In FIG. 1 it can be seen that the latches 23 formed in a shaft part 13 for fastening the two warp yarn guiding bodies 20 are facing each other with their free ends 23*a*.

In FIG. 1 only two of the shaft projections 22 can be seen. On the side facing away from the viewer, shaft projections 23 do also exist on the respectively other shaft part 13, said shaft projections not being shown in the drawing. As has been explained, the heddle 10 is symmetrical to its longitudinal center plane.

A recess 25 is provided on each warp yarn guiding body 20, into which recess at least one associate shaft projection 22 may engage. In the first exemplary embodiment 10, each shaft projection 22 is associated with a separate recess 25. Alternatively, it is also possible for several shaft projections 23 to engage in one recess 25 when several shaft projections 22 are provided on each shaft part 13 for fastening or positioning the warp yarn guiding bodies 20, as is the case, for example, in the exemplary embodiment according to FIG. 8.

The warp yarn guiding body 20 of the first exemplary embodiment 10*a* of the heddle 10 thus has two recesses 25, each being arranged on opposite sides in transverse direction A. Each recess is open toward one side surface 26 of the warp yarn guiding body 20. Each lateral surface 26 of the warp yarn guiding body 20 is associated with a shaft part 13 and abuts at least partially against said shaft part.

The shape or the contour of the recess 25 may be selected depending on the shape and contour of the shaft projection 22. In the first exemplary embodiment 10*a* of the heddle 10, the respective recess 25 does not match the dimensions of the shaft projection 22. The dimensions of the recess 25, in accordance with the example, are greater in one or two spatial directions than the dimensions of the shaft projection 22. The width of the recess 25 measured in warp yarn direction K may correspond to the width of the shaft projection 22. The width of the shaft projection 22 is less than the width of the strip-shaped shaft part 13 measured in warp yarn direction K. In this first exemplary embodiment 10*a*, the recess 25 has the approximate contour of a parallel epiped.

In the first exemplary embodiment 10*a* of the heddle 10, each warp yarn guiding body 20 has on its lateral surfaces an extension 27 extending in transverse direction Q. This extension 27 engages in a recess 28 on the shaft part 13 that, for example, is configured as a recess without opening. The recess 28 may be formed by cutting out the latch 23 and bending it inward. In doing so, it is possible that—when the latch 23 is being exposed—to cut out or punch out a region that belongs to the recess 28 in order to enlarge the recess 28 adjoining the free end 23*a* of the latch 23. The length of the extension 27 corresponds to at most the thickness of the shaft part 13—always measured in transverse direction Q, so that the extension 27 does not project from the recess 28 of the shaft part 13 on the outside 12*a* of the heddle shaft 12 facing away from the yarn eye 11. This extension may be flush with the shaft part 13 as is illustrated, in particular, by FIGS. 2 and 3.

Considering the exemplary embodiment, the width of the extension 27 and the width of the recess 28—each measured in warp yarn direction K—correspond to each other. In particular, this width may also be identical to the width of the shaft projection 22 or the latch 23. The extension 27 has at least one and, in accordance with the example, two specifically parallel flat sides 29 that are provided on opposite sides of the extension 37 in warp yarn direction K and that, preferably, abut against a respective edge of the recess 28. In this manner, the warp yarn guiding body 20 is secured against rotation and is arranged, defined in its orientation, on the shaft part 23.

Figure 5:
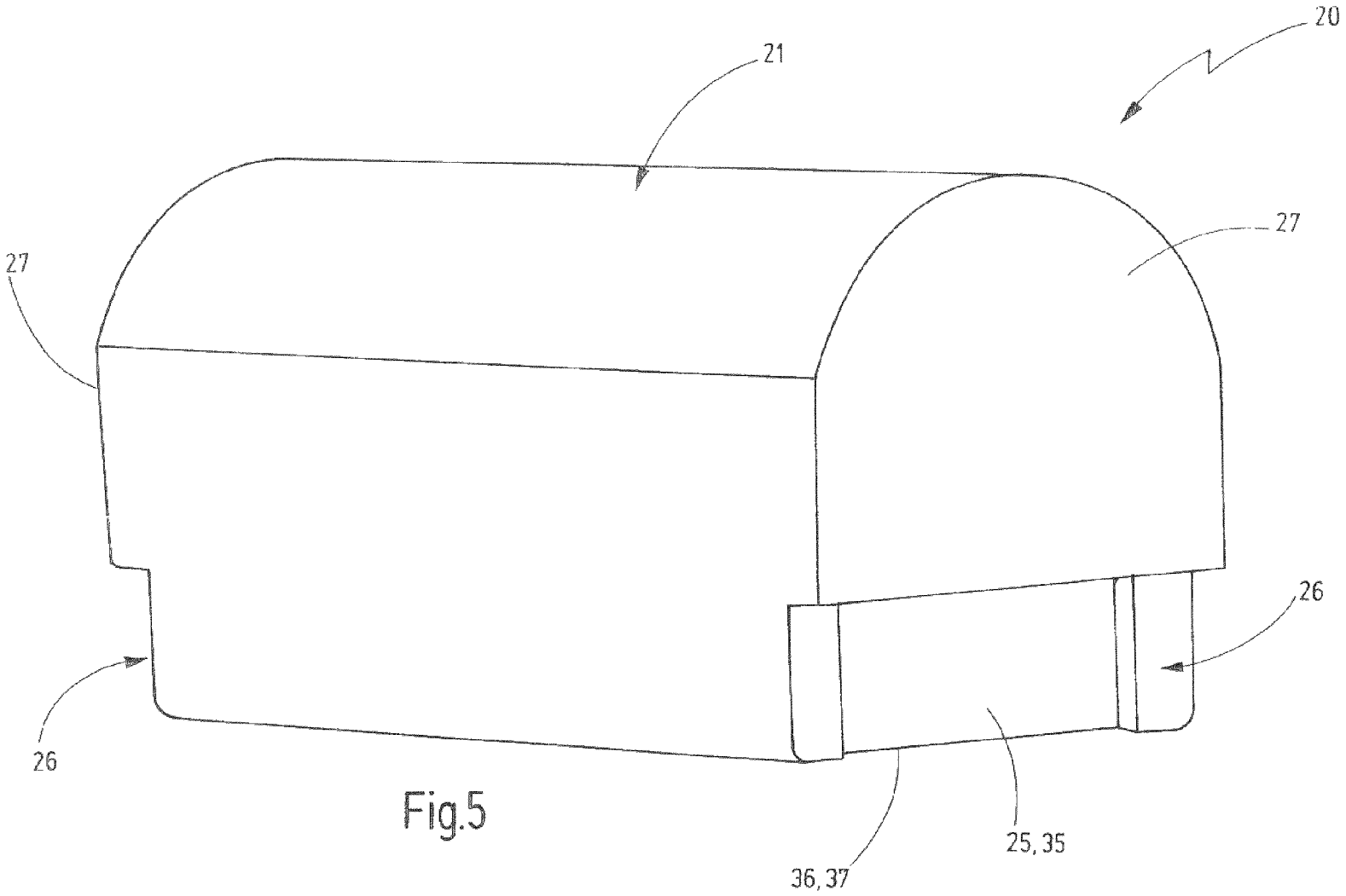
FIG. 5 a perspective representation of another alternative embodiment option of the warp yarn guiding body.
Figure 5A:
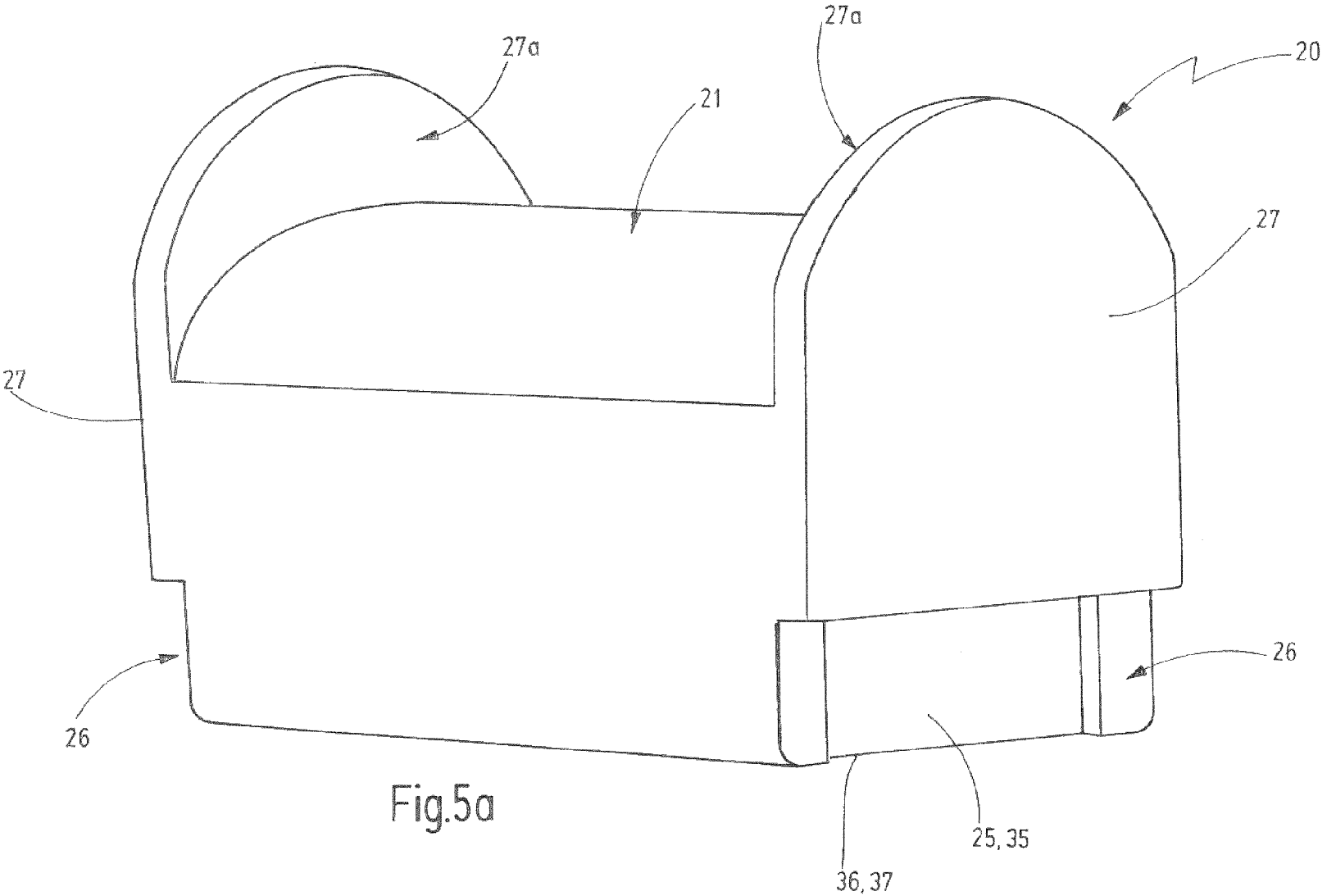
FIG. 5*a* a perspective representation of a modified embodiment of the warp yarn guiding body as in FIG. 5.

In a few of the embodiments described herein, the extension 27 transitions without offsets and edges into the guiding surface 21. Adjoining the guiding surface 21, the extension 27 is therefore curved in warp yarn direction K, consistent with the guiding surface 21. As a result of this, the guiding surface 21 is extended, as it were, without offsets and edges into the recess 28 due to the extension 27. Alternatively thereto, it is possible in all embodiments for a transition surface 27*a* extending essentially along the adjacent shaft part 13 to exist inside the yarn eye 11, said transition surface 21 connecting the guiding surface 21 and the extension 27 without gaps (FIG. 5*a*). The transition surface 27*a* is configured so as to be free of gaps. Both embodiments have the advantage that no gap can form in extension direction E between the inside 30 of the shaft part 13 facing the yarn eye 11 and the guiding surface. The warp yarn could be caught and/or damaged in such a gap.

Measured in transverse direction Q, the width of the warp yarn guiding body 20 decreases from the guiding surface 21 in extension direction E. Thus the warp yarn guiding body 20 tapers from the yarn eye 11 in the direction toward the end eyelet 16. In the first exemplary embodiment 10*a* of the heddle 10, the lateral surfaces 26 of the warp yarn guiding body 20 are inclined at an angle relative to extension direction E. In accordance with the example, the lateral surfaces 26 do not exhibit a uniformly consistent inclination but have a first surface section 26*a* and a second surface section 26*b*. The two surface sections 26*a* and 26*b* directly adjoin each other. The first surface section 26*a* subtends a first angle of inclination $\alpha 1$ with a parallel relative to extension direction E, and the second surface section 26*b* subtends a second angle of inclination $\alpha 2$ different therefrom. The second angle of inclination $\alpha 2$ is larger than the angle of inclination $\alpha 1$. The second surface section 26*b* directly adjoins the rear side 31 of the warp yarn guiding body 20 opposite the guiding surface 21. The first surface section 26*a* extends from the second surface section 26*b* to the surface section 21. Both surface sections 26*a*, 26*b* are divided by the recess 25 and the extension 27, respectively, into spaced apart partial regions, wherein, in accordance with the example, the extension 27 is arranged between the two partial areas of the first surface section 26*a*. In accordance with the example, the extension 27 directly adjoins the recess 25.

As shown by FIG. 2, the guiding body 20 can abut only along the first surface section 26*a* in a planar manner against the respectively associate shaft part 13, while, in accordance with the example, a wedge-shaped gap exists between the surface section 26*b* and the shaft part 13.

Referring to the preferred exemplary embodiments described herein, the warp yarn guiding bodies 20 are connected to the shaft parts 13 in a bonding manner. To accomplish this, the warp yarn guiding body 20 comprises a glue reservoir 35 that is open to the respective lateral surface 26. In the first exemplary embodiment 10*a* of the heddle 10 as in FIGS. 1 through 3, this glue reservoir 35 is filled with glue—either before the warp yarn guiding body 20 is connected to the heddle shaft 12 or after the temporary connection and positioning is formed by the shaft projections 22 and the recesses 25. A bonding connection inside the recess 25 has the advantage that the amount of glue need be metered only approximately. Excess glue remains in the glue reservoir 35 formed by the recess 25. Deviations from the form inside the yarn eye 11 or in the region of the outside, or outside surface, of the heddle shaft 12 are avoided. Wherever the heddle shaft 12 comes into contact with a warp yarn such deviations from the shape or unevennesses mat lead to an increased stress on the warp yarns or even to damage. This is avoided with the heddle 10 described herein.

Figure 4:
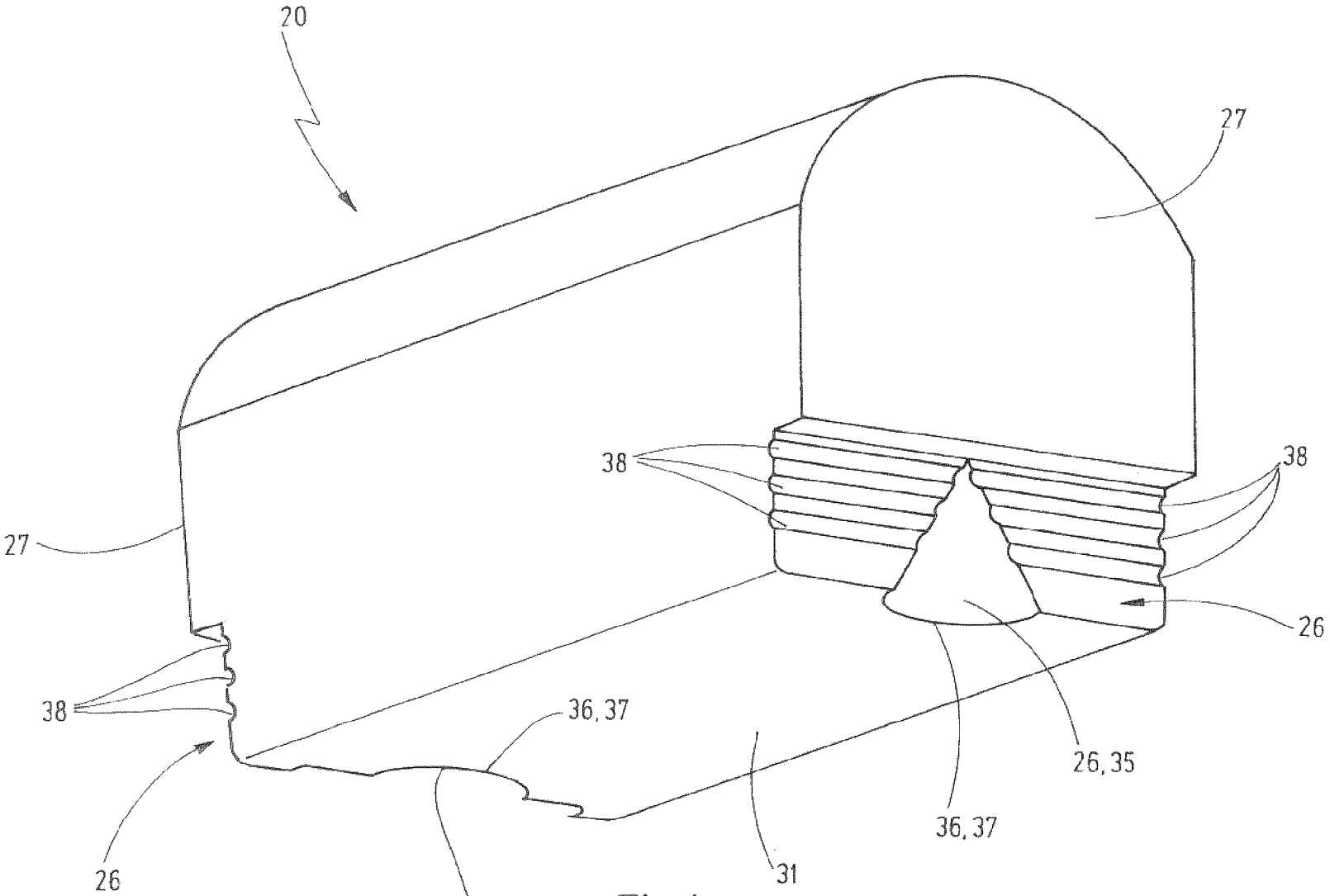
FIG. 4 a perspective representation of an alternative embodiment of a warp yarn guiding body.

In the exemplary embodiment 10*a* of the heddle 10 of FIG. 1, it is possible to also use other warp yarn guiding bodies 20. Additional exemplary embodiments of warp yarn guiding bodies 20 are illustrated by FIGS. 4 and 5. The configuration of the heddle 10 described in conjunction with FIGS. 1 through 3 may correspond to that of the first exemplary embodiment 10*a*, so that reference is made to the explanations regarding the first exemplary embodiment 10*a*. Concrete deviations from this exemplary embodiment due to the use of the modified warp yarn guiding bodies 20 will be explained hereinafter.

Whereas the extension 27 measured in warp yarn direction K in the warp yarn guiding bodies 20 represented in FIGS. 1 through 3 is smaller than the maximum width of the warp yarn guiding body 20, the maximum width of the extension 27 corresponds to the maximum width of the warp yarn guiding body 30 in the exemplary embodiments of FIGS. 4 and 5. The lateral surface 26 adjoining the extension 27 and being intended for abutment with the respective shaft part 27 in the embodiments of FIGS. 4 and 5 is not inclined relative to extension direction E, but extends in a plane that is defined by the extension direction E and the warp yarn direction K. In modification of the illustrated exemplary embodiments, the lateral surface 26 may be inclined as in the first exemplary embodiment, in which case the inclination of the lateral surface 26 may be constant or have different sizes in different surface sections as in the first exemplary embodiment.

The recess 25 or the glue reservoir 35 has the shape of a conical segment in the exemplary embodiment of FIG. 4. The size of the recess 25 or the glue reservoir 35 decreases starting from the rear side 31 along the lateral surface 26 toward the extension 27. In the exemplary embodiment shown by FIG. 5, the recess or the glue reservoir 35 has essentially the form of a parallel epiped.

In all the exemplary embodiments the glue reservoir has an orifice 36 on the rear side 31. This orifice 36 on the rear side 31 represents the filling opening 37 for the glue. The glue can be filled when the warp yarn guiding body 20 is positioned, or temporarily held, in place by the shaft projections 22 between the two shaft parts 13. In doing so, the shaft projection 22 is connected in the recess 25 to the warp yarn guiding body 20 in a material-bonded manner.

In order to be able to also achieve a bonding connection between the warp yarn guiding body 20 and the shaft parts 13 outside the recess 25, the exemplary embodiment shown in FIG. 4 has one or more flow grooves 38 in the lateral surface 26. In the exemplary embodiment, the flow grooves 38 extend parallel to each other in warp yarn direction K. In the exemplary embodiment of FIG. 4 six flow grooves 38 are provided in each lateral surface 26. The flow grooves 38 may have any cross-sectional form and have a cross-section in the form of a half circle or a segment of a circle. The flow grooves 38 terminate in the glue reservoir 35, so that they are in fluidic communication with the glue reservoir 35. In the exemplary embodiment, each flow groove 38 extends through the lateral surface 26 from the glue reservoir 35 to an edge of the lateral surface 26. It is also possible for the flow grooves 38 to be closed toward the edge of the lateral surface 26 of the warp yarn guiding body 20 or to end at a distance from this edge, so that any exiting of the glue via the flow grooves 38 is prevented.

Also, in the warp yarn guiding body 20 shown by FIG. 5, at least one flow groove 38 could be provided in each lateral wall 26. In the exemplary embodiment shown by FIGS. 1 through 3, there could also be at least one flow groove at least in the first surface section 26*a* of the lateral surface 26.

Different from the exemplary embodiment shown by FIG. 4, the at least one flow groove 38 may also be in an orientation different from warp yarn direction K. Preferably, each flow groove extends in a straight line from the glue reservoir 35, in which case—in principle—a curved or bent line is also conceivable.

Considering the first exemplary embodiment 10*a* of the heddle 10 described in conjunction with FIGS. 1 through 3, the shaft part 13 has cutouts, slits or recesses in the region of the shaft projection 22. Alternatively, the shaft projection 22 may be produced by a deformation and not have any gaps along its circumference and be connected to the remaining shaft part 13 without seams and joints, as is the case in the second exemplary embodiment 10*b* of FIG. 6, the third exemplary embodiment 10*c* of FIG. 7, and the fourth exemplary embodiment 10*d* of FIG. 8. Considering these three exemplary embodiments, the shaft projections 22 are nub-shaped embossings in the shaft parts 13, as exemplified. On the side associated with the respective warp yarn guiding bodies 20, consistent with the example, projections 22 that are nub-like or like spherical segments are formed by embossing, while concavities 40 are formed on the opposite outside 12*a* of the heddle shaft.

Figure 6:
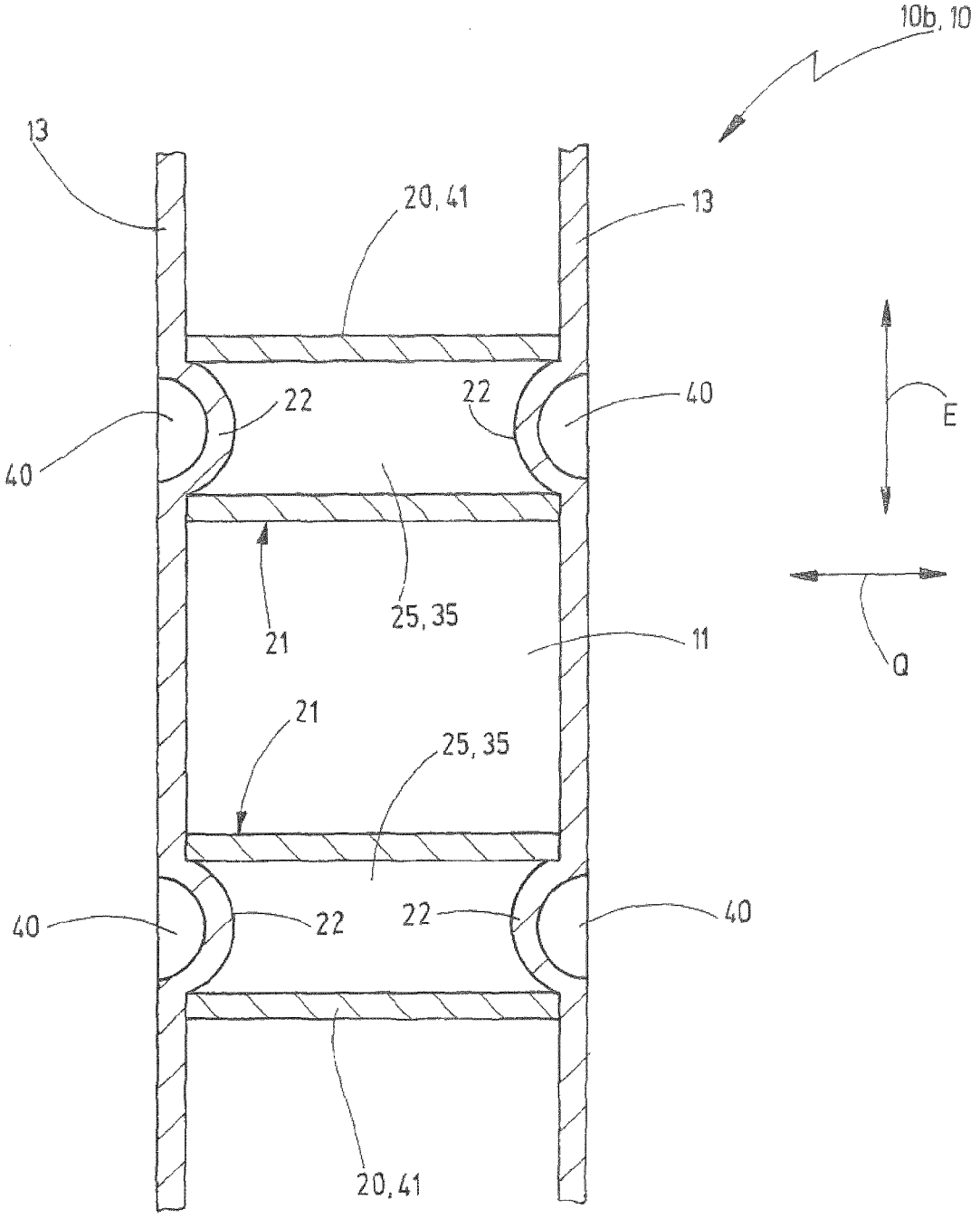
FIG. 6 a schematic partial representation of a second exemplary embodiment of a heddle, in cross-section in the region of the yarn eye.
Figure 7:
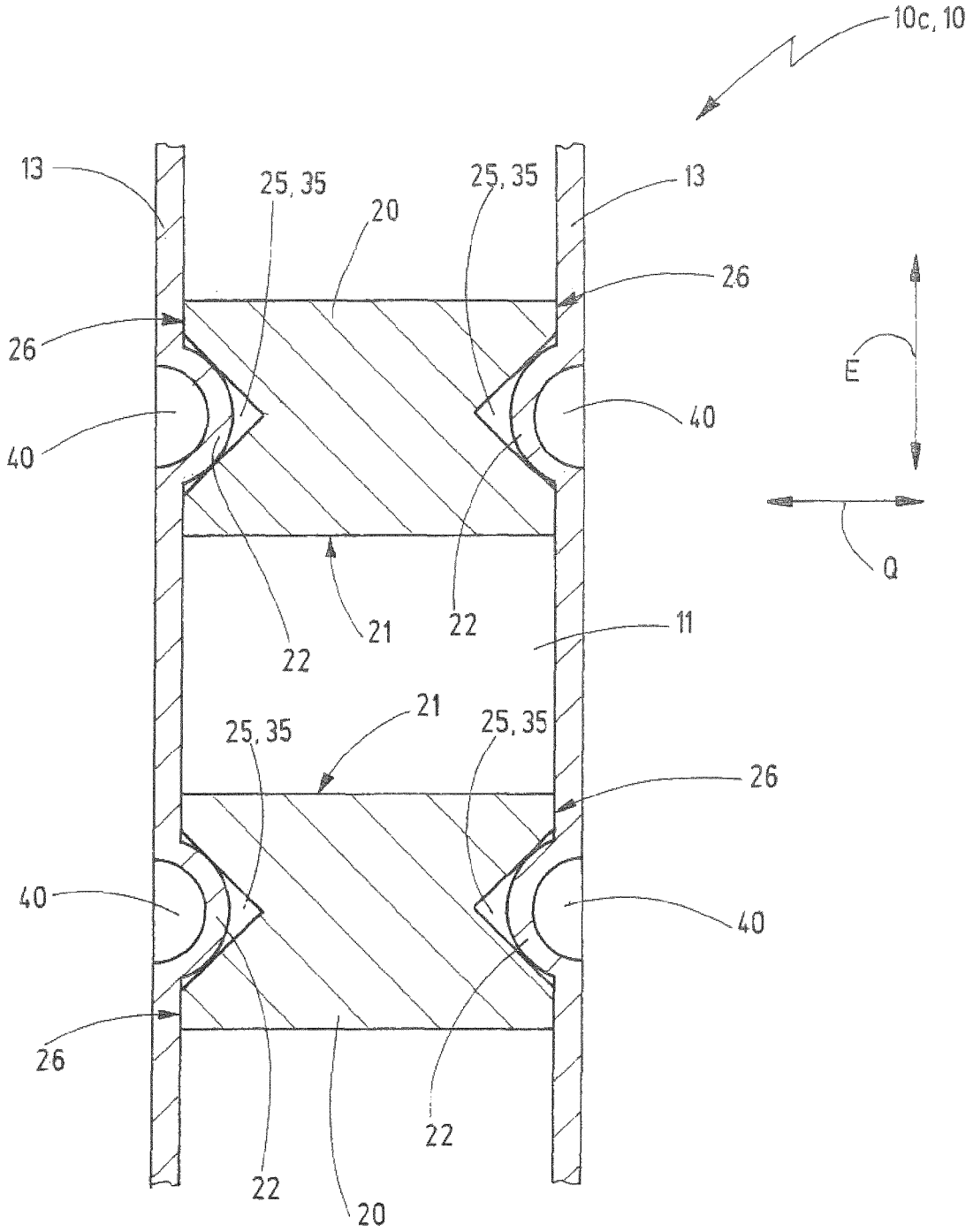
FIG. 7 a schematic partial representation of a third exemplary embodiment of a heddle in accordance with the invention, in cross-section in the region of the yarn eye.

In the exemplary embodiment shown in FIG. 6, the warp yarn guiding bodies 20 are represented by tube pieces 41. The cylindrical hollow space delimited by the tube piece 41 represents the recess 25 that, in this exemplary embodiment, is associated with the shaft projections 22 of both shaft parts 13. In this exemplary embodiment the recess 25 also acts as the glue reservoir 35.

The warp yarn guiding bodies 20 have a cylindrical form in the second exemplary embodiment 10*b* of the heddle 10, as well as in the third exemplary embodiment 10*c* of the heddle 10. In doing so, the guiding surface 21 on each warp yarn guiding body 20 is formed by a section of the cylindrical surface. The shape and configuration of the recess 25 or recesses 25 of each warp yarn guiding body 20 can principally be selected as desired. Whereas in the second exemplary embodiment 10*b* of the heddle 10 a single cylindrical recess 25 is provided on each warp yarn guiding body 20, each warp yarn guiding body 20 in the third exemplary embodiment 10*c* of the heddle 10 has a prism-shaped or pyramid-shaped recess 25 in each lateral surface 26 that also may act as glue reservoirs 35.

Figure 8:
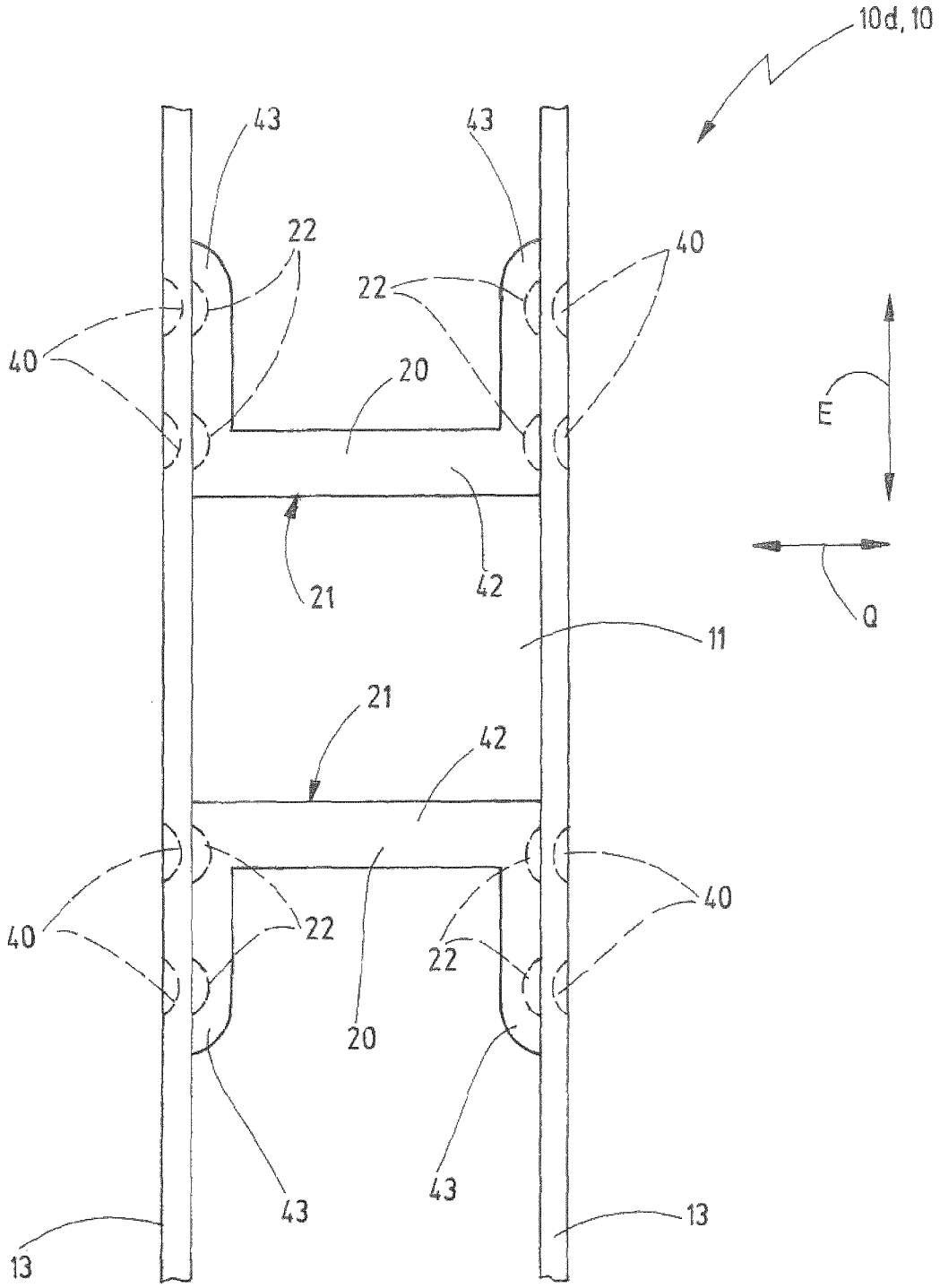
FIG. 8 a schematic partial representation of a fourth exemplary embodiment of a heddle in accordance with the invention.

The fourth exemplary embodiment 10*d* of the heddle 10 is schematically illustrated by FIG. 8. There, different from the exemplary embodiments so far, each shaft part has more than one shaft projection 22 per warp yarn guiding body 20. The recesses 25 present in the warp yarn guiding body 20 are adapted to the shape and size of the shaft projections 22, as a result of which a positive connection can be formed between the shaft projections 22 and the respective recess 25. Alternatively, it is also additionally possible to provide a glue gap between the wall of the respective recess 25 and the associate shaft projection 22, so that the recesses 25 may also act as glue reservoir 35. In accordance with the example, each shaft projection 22 is associated with a recess 25.

As in the fourth exemplary embodiment 10*d* of the heddle 10, the warp yarn bodies 20 have a guiding surface 21 extending in a curve in warp yarn direction K. This guiding surface is provided on a guiding section 42 of the warp yarn guiding body 20. The guiding section 42 extends between the two shaft parts 13. A yarn eye 11 is formed between the two guiding sections 42 of the two warp yarn guiding bodies 20.

Each warp yarn guiding body 20 has two limbs 43 extending transversely from the guiding section 42, said limbs having the side surface 26 of the warp yarn guiding body 20. Each limb 43 is associated with a shaft part 13 and abuts against said shaft part. The warp yarn guiding body 20 thus is U-shaped.

The invention relates to a heddle 10 which is provided and designed, in particular for weaving strip-shaped warp yarn. Said heddle 10 comprises a heddle shaft 12 which is formed by two shaft parts 13. Said shaft parts 13 are directly placed next to each other in a respective end section 15 of the heddle shaft 12 and interconnected. The end eyelets 16 of the heddle 10 are also in said end section 15. In order to form a yarn eye 11 between both shaft parts 13, two separate warp yarn guiding bodies 20 are placed between the shaft parts 13. In order to determine the position of the warp yarn guiding body 20 with respect to the heddle shaft 12, at least one shaft projection 22 is produced by stamping and subsequent bending or by embossing, on each shaft part 13 for each warp yarn guiding body 20. Said shaft projection 22 engages in an associate recess 25 of the warp yarn guiding body 20, and a bonding connection, preferably in the recess 25 between the shaft projection 22 and the warp yarn guiding body 20 is produced.

LIST OF REFERENCE SIGNS

10 Heddle
10*a* First exemplary embodiment of the heddle
10*b* Second exemplary embodiment of the heddle
10*c* Third exemplary embodiment of the heddle
10*d* Fourth exemplary embodiment of the heddle
11 Yarn eye
12 Heddle shaft
12*a* Outside of the heddle shaft
13 Shaft part
14 Free end of the heddle shaft
15 End section
16 End eyelet
20 Warp yarn guiding body
21 Guiding surface
22 Shaft projection
23 Latch
23*a* Free end of the latch
23*b* Stationary end of the latch
25 Recess
26 Lateral surface of the warp yarn guiding body
27 Extension
27*a* Transition surface
28 Cutout
29 Flat side
30 Inside of the shaft part
31 Rear side of the warp yarn guiding body
35 Glue reservoir
36 Orifice
37 Filling opening
38 Flow groove
40 Concavity
41 Tube piece
42 Guiding section
43 Limb
$\alpha$1 First angle of inclination
$\alpha$2 Second angle of inclination
E Direction of extension
K Warp yarn direction
Q Transverse direction The invention is:

1. A heddle (10) for a loom, the heddle comprising:
a heddle shaft (12) having two end sections (15), each end section having a respective end eyelet (16);
two separate shaft parts (13) of the heddle shaft extending, at least in sections, spaced-apart from each other,
at least two spaced apart warp yarn guiding bodies (20) formed from a single ring element or separate bodies that are arranged between the two shaft parts (13) and delimits a yarn eye (11) for a warp yarn,
wherein each shaft part (13) is provided with at least one shaft projection (22) produced by stamping and/or bending and/or embossing, said shaft projection engaging in a respective associated recess (25) on one of the at least two spaced apart warp yarn guiding bodies (20) in order to position the one of the at least two spaced apart warp yarn guiding bodies (20) on the heddle shaft (12) or to fasten it thereto.

2. The heddle as in claim 1, wherein the two shaft parts (13) are strip-shaped.

3. The heddle as in claim 1, wherein individual ones of the at least two spaced apart at least one warp yarn guiding bodies (20) are connected to the two shaft parts (13) in a material-bonded manner.

4. The heddle as in claim 1, wherein the (20) single ring element includes the yarn eye (11), or two of the at least two spaced-apart warp yarn guiding bodies (20) extending in an extension direction (E) of the heddle shaft (12) delimit the yarn eye (11) on one upper side and one lower side.

5. The heddle as in claim 1, wherein the shaft projection (22) is connected to the shaft part (13) without any gaps in a circumferential direction.

6. The heddle: as in claim 1, wherein the shaft projection (22) is formed by a latch (23) that is exposed from the shaft part (13) by stamping.

7. The heddle as in claim 1, wherein at least one of the at least two warp yarn guiding bodies (20) has two sides with one extension (27) on each of both sides, and each extension engaging in a recess (28) on a respective associated shaft part (13).

8. The heddle as in claim 7, wherein each extension (27) transitions without offsets in a guiding surface (21) configured for support of warp yarn, or that a transition surface (27*a*) extending essentially along an adjacent shaft part (13) inside the yarn eye (11) is provided, said transition surface connecting the guiding surface (21) and the extension (27) without gaps.

9. The heddle as in claim 1, wherein at least one of the at least two warp yarn guiding bodies (20) tapers in an extension direction (E) of the heddle shaft (12) away from the yarn eye (11).

10. The heddle as in claim 9, wherein the at least one of the at least two warp yarn guiding bodies (20) has one lateral surface (26) extending, at least in sections, in an inclined or arcuate manner relative to the extension direction (E).

11. The heddle as in claim 10, wherein the lateral surface (26) has a first surface section (26*a*) and a second surface section (26*b*) which form different angles of inclination ($\alpha$1, $\alpha$2) relative to the extension direction (E).

12. The heddle as in claim 1, wherein at least one of the at least two warp yarn guiding bodies (20) has, in a lateral surface (26) associated with the respective shaft part (13), at least one flow groove (38) for distribution of glue.

13. The heddle as in claim 1, wherein at least one of the at least two warp yarn guiding bodies (20) has a glue reservoir (35) that is open to a lateral surface (26) associated with the respective shaft part (13).

14. The heddle as in claim 13, wherein the recess (25) on the one of the at least two warp yarn guiding bodies (20) acts as the glue reservoir (35).

15. The heddle as in claim 13, wherein the glue reservoir (35) terminates at a filling opening (37) on a rear side (31) of the one of the at least two warp yarn guiding bodies (20), said rear side facing away from a guiding surface (21) configured for the support of warp yarn.

16. A method for the production of a heddle (10) for a loom, in particular a circular loom, wherein the heddle (10) has a heddle shaft (12) having two end sections (15), each end section having a respective end eyelet (16) and the heddle shaft has two shaft parts (13) extending, at least in sections, spaced-apart from each other, and wherein the heddle (10) has at least two spaced apart warp yarn guiding bodies (20) formed from a single ring clement or separate bodies that are arranged between the two shaft parts (13) and delimits a yarn eye (11) for a warp yarn, the method comprising:

producing at least one shaft projection (22) on each shaft part (13) by stamping and/or bending and/or embossing and connecting the two shaft parts (13) at least in the two end sections (15) of the heddle shaft (12), arranging and/or fastening at least one of the at least two warp yarn guiding bodies (20) between the two shaft parts (13) in such a manner that the at least one shaft projection (22) of each shaft part (13) engages in a respective associated recess (25) on the at least one of the at least two warp yarn guiding bodies (20).

* * * * *